US005642826A

United States Patent [19]

Melrose

[11] Patent Number: 5,642,826

[45] Date of Patent: Jul. 1, 1997

[54] COLLAPSIBLE CONTAINER

[75] Inventor: David Murray Melrose, Auckland, New Zealand

[73] Assignee: CO2PAC Limited, Auckland, New Zealand

[21] Appl. No.: 693,848

[22] Filed: Aug. 5, 1996

Related U.S. Application Data

[63] Continuation of Ser. No. 232,180, filed as PCT/GB92/01977, Oct. 28, 1992, abandoned.

[30] Foreign Application Priority Data

Nov. 1, 1991 [NZ] New Zealand ..... 240448

[51] Int. Cl.[6] ..... B65D 1/02; B65D 1/46

[52] U.S. Cl. ..... 215/382; 215/900; 220/8; 220/666; 220/907

[58] Field of Search ..... 215/379, 382, 215/900; 220/8, 606, 666, 669, 672, 673, 675, 907

[56] References Cited

U.S. PATENT DOCUMENTS

| | | | |
|---|---|---|---|
| Re. 32,379 | 3/1987 | Touzant | 215/900 X |
| 2,899,110 | 8/1959 | Parker | 215/900 X |
| 3,081,002 | 3/1963 | Tauschinski et al. | 222/107 X |
| 3,220,544 | 11/1965 | Lovell | 220/8 X |
| 3,301,293 | 1/1967 | Santelli | 220/666 |
| 3,506,163 | 4/1970 | Rauh et al. | 222/215 X |
| 3,626,939 | 12/1971 | Maltenfort et al. | 220/107 X |
| 3,872,994 | 3/1975 | Hyde | 215/1 C X |
| 3,918,603 | 11/1975 | Hatada | 215/1 C X |
| 4,377,191 | 3/1983 | Yamaguchi | 220/907 X |
| 4,456,134 | 6/1984 | Cooper | 215/1 C X |
| 4,773,458 | 9/1988 | Touzani | 215/1 C X |
| 4,790,361 | 12/1988 | Jones et al. | 215/1 C X |
| 4,865,211 | 9/1989 | Hollingworth | 220/8 |
| 4,873,100 | 10/1989 | Dirksing et al. | 215/1 C X |
| 5,114,011 | 5/1992 | Robbins, III | 215/900 X |
| 5,348,173 | 9/1994 | Norwood | 215/900 X |
| 5,384,138 | 1/1995 | Robbins, III et al. | 215/900 X |

FOREIGN PATENT DOCUMENTS

| | | | |
|---|---|---|---|
| 688612 | 7/1964 | Canada | 215/1 C |
| 2316132 | 1/1977 | France | 220/907 X |
| 63281955 | 11/1983 | Japan | 215/1 C |
| 1226556 | 9/1989 | Japan | 220/669 |
| 781103 | 8/1957 | United Kingdom | 222/95 |
| 8805014 | 7/1988 | WIPO | 220/666 |

*Primary Examiner*—Sue A. Weaver

*Attorney, Agent, or Firm*—Christensen O'Connor Johnson & Kindness PLLC

[57] ABSTRACT

A semi-rigid container, has a semi-rigid folding portion consisting of the plurality of diamond shaped panels forming a frustoconical shape. The panels are arced relative to the interconnecting frustoconical substrate in the transverse and longitudinal directions so that while the panels provide rigidity against a longitudinal collapsing force, they are able to expand transversely to enable folding of the folding portion under the longitudinal collapsing force and to resist expansion from the collapsed state. Other shapes of the panels are also described.

10 Claims, 11 Drawing Sheets

COLLAPSIBLE CONTAINER

This application is a continuation application of application Ser. No. 08/232,180, filed as PCT/GB92/01977 on Oct. 28, 1992, now abandoned.

FIELD OF THE INVENTION

This invention relates to containers, particularly semi-rigid collapsible containers. The invention has particular though not exclusive relevance to containers for the storage of aerated liquids and the like. The term "semi-rigid" container refers to a container of a material such as polyethylene terephalate (PET) which will not be deformed by or take up the shape of its contents, as is the case with a "flexible" container, although the container has some flexibility to distinguish it from a "rigid" container. The term "semi-rigid" is used in this context throughout this specification, including the claims.

BACKGROUND TO INVENTION

Aerated liquids, such as aerated beverages and the like are typically stored under pressure, in airtight containers or the like, in order to maintain the liquid in an aerated state, or at least reduce the extent to which the gas, whether carbon dioxide or other gas, escapes from the liquid.

Once the container has been opened, the gases tend to discharge from the liquid. The process of discharge can be slowed to a certain extent by resealing the container. However, after resealing, there is typically an enlarged head space available into which the gas can discharge.

It is well known that if the head space can be decreased as the beverage or other liquid volume decreases, so the extent to which gas is discharged or otherwise lost from the liquid may be reduced. To this end, a number of collapsible containers have been provided to date. Some of these collapsible containers have been of the bellows-type. Such containers possess a number of disadvantages.

Primarily, these containers do not function as pressure vessels, so they cannot be used to house soft drink prior to sale. If such a container is filled with soft drink, the internal pressure from the liquid forces the container to over expand after the cap is placed on. The container overstretches into a 'blown-out' state allowing a large headspace to develop with resulting loss of carbonation. This would occur with even mild agitation, and the container could never be expected to withstand the rigours of transportation and handling methods expected of a soft drink vessel leaving the bottling plant.

Secondly, this capacity of bellows-type containers to expand as well as collapse means that after the container base been partially collapsed and recapped, it is susceptible to re-expansion and subsequent loss of carbonation as the pressure from the liquid forces a headspace to form, particularly if the container was to be dropped or shaken in any way. This rather defeats the intended purpose.

Though some bellows-type containers possess improvements, they do not fully overcome the abovementioned problems. They must also be manufactured to relatively fine tolerances and are relatively inconvenient to use.

U.S. Pat. No. 4,790,361 (Jones et al) attempted to overcome the problem of over expansion before any collapse is required, after the container is filled. Unfortunately, this can never be achieved in a bellows-type container without some external clamping device to hold it in place. Such a device would have to be joined to the container, resulting in increased expense. While this container might partially resist expansion 'beyond full' it would still yield to the very high pressures generated from agitated soft drink.

As such expansion occurs, the intended shape of the Jones et al container would also be 'stretched out' of the plastic, resulting in irreparable damage to the polymer. This container would also be virtually impossible to manufacture in the current plastics of choice—polyethylene terephthalate (PET). Also, due to the large surface area of such a container there would be increased expense in material costs. This container would also be susceptible to re-expansion from a collapsed state.

Jones et al has its corrugations defined by a plurality of ridges and grooves, each ridge preferably consisting of planar regions defined by quadrilaterals and acting as a hinge about which the collapsing can take place. U.S. Pat. No. 4,492,313 (Touzani) also does not function initially as a pressure vessel. It, too, cannot therefore be used to package soft drink prior to sale. Touzani does go some way in overcoming the problem of re-expansion from a partially collapsed state. The method in which Touzani achieves this introduces other problems however. The container collapses in a somewhat 'sectional' manner, and expels the contents in "jumps", which may not match the volume of headspace left. This sectional manner of collapse also results in some of the contents splashing out. Also, the operator can accidentally over compress the container after the cap has been placed on (by folding the rings down), the result of which is some overflow of the contents when the cap is next released.

In British Patent Specification 781, 103 (International Patents Trust) a container for a viscous material such as toothpaste is provided with axial corrugations along its side wall. Pressure on the base enables it to move inwardly of the wall as the wall folds, dispensing the material. In U.S. Pat. No. 4,865,211 (Hollingworth), Netherlands Patent 294186 (Metal Box), U.S. Pat. No. 4,456,134 (Cooper) and French Patents 2294297 (Normos) and 623181 (Leisse) various other collapsible containers are proposed, using a concertina or other folding wall type construction. These containers are not suitable for soft drink however. The containers of U.S. Pat. No. 4,865,211 and UK Patent 781,103 are particularly unsuitable as they are more easily subjected to internal pressure that would over expand them when full as a result of the corrugations and tucks they each employ.

These containers would also re-expand readily from a collapsed state, particularly as they are designed with a flexible material. UK Patent 781,103 is particularly susceptible to re-expansion.

Each of these containers collapses with the fold in a circular or ring shape best illustrated by FIG. 8 in U.S. Pat. No. 4,865,211. Reference is specifically made in NL Patent 294186 and UK Patent 781,103 to the wall folding upon itself or to lie against the uncollapsed circular wall yet to be folded. The walls in these containers are made of a flexible material like polythene. In the case of UK Patent 781,103 the contents are not fluid but are somewhat viscous. This provides support to the container walls under collapsing forces, as the material resists movement therein. This helps the flexible walls to resist buckling under collapsing forces.

Other collapsible containers have included a relatively flexible bag portion which is collapsed to reduce the available headspace. While simple bag-in-the-box collapsible containers can house a liquid like 'still' wine, they cannot house beverages under pressure, such as 'sparkling' wine. This is due to the propensity a simple bag has to re-expand after collapse if there is pressure within. Improvements to this type of collapsible container have therefore to date concentrated on requiring some separate control means such as an outer container, shell or the like to control collapse and maintain the collapsed container in the collapsed state. The external control device would add considerable cost to the container as it would always have to accompany the bag. Examples of such containers are described in the patents to Cooper and Normos referred to above.

With regard to the bases of PET and other plastics containers, various proposals have been made as to possible designs, one of the most popular at the present time being the "petaloid" base of New Zealand Patent 227274 (Continental Pet Technologies, Inc).

It is an object of at least one embodiment of this invention to come some way in overcoming the problems mentioned above or at least to provide the public with a useful choice.

Other objects of this invention will become apparent from the following description.

SUMMARY OF THE INVENTION

According to one aspect of this invention there is provided a semi-rigid container, a side wall of which has a folding portion having a plurality of panel means each being arcuate (as herein defined) at least in a direction transverse to the longitudinal axis of said container and being so disposed that said panel means act together to resist expansion of said folding portion from a collapsed state and provide rigidity against a longitudinal collapsing force while enabling progressive folding of said folding portion under said longitudinal collapsing force whereby said folding portion folds relative to a remaining portion of container in reducing the internal volume of said container.

Further aspects of this invention will become apparent from the following description.

BRIEF DESCRIPTION OF THE DRAWINGS

The present invention will now be described by way of example and with reference to the accompanying drawings in which.

DESCRIPTION OF THE PREFERRED EMBODIMENTS

Figure 1:
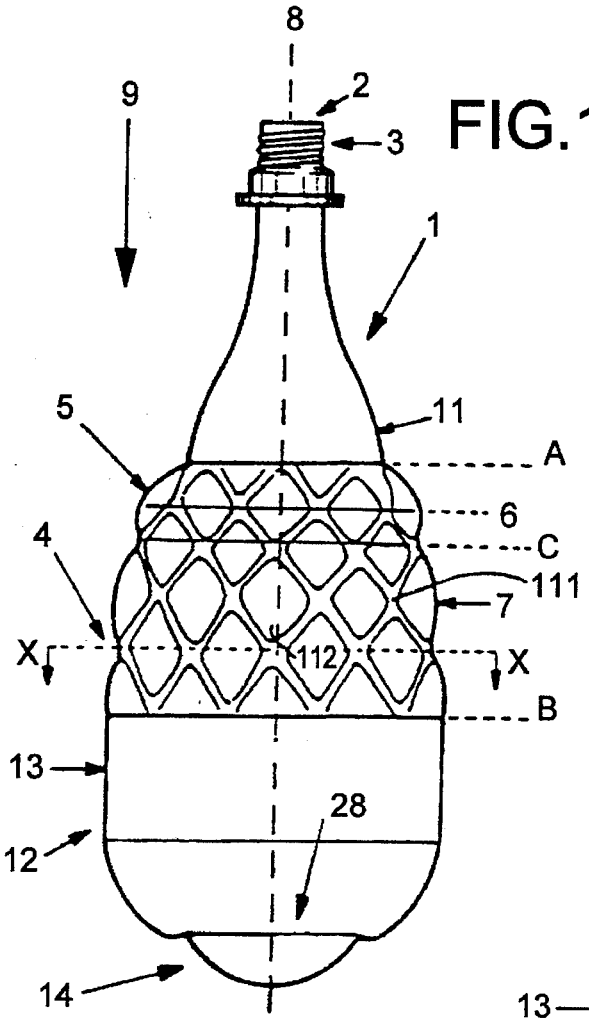
FIG. 1 is a schematic side-view of an exemplary embodiment of this invention.

The exemplary embodiments shown in the drawings, and the following description in relation to those drawings, are provided by way of example only and are not intended to be restrictive of the possible embodiments of the invention.

In FIG. 1, an exemplary semi-rigid container 1 can be seen. Container 1 is a substantially elongate soft drink bottle. It has an opening 2 at one end and is provided with thread 3 to facilitate resealing using a threaded cap (not shown). Container 1 is in this example formed in polyethylene terephthalate (PET), though any suitable material may be used to provide the characteristics of semi-rigidity.

Sidewall 4 of container 1 is provided with a folding portion 5. In this example, the folding portion is defined between dotted lines A and B.

Figure 2:
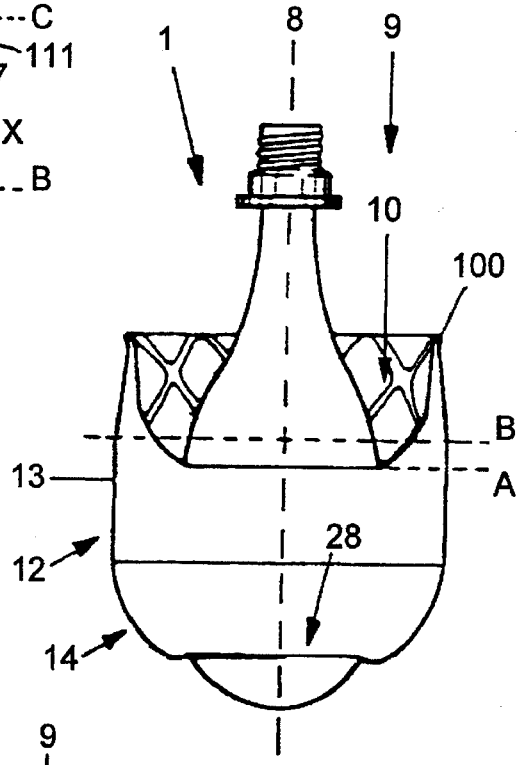
FIG. 2 is a schematic sectional view of the embodiment in FIG. 1 in a partially collapsed condition.
Figure 3:
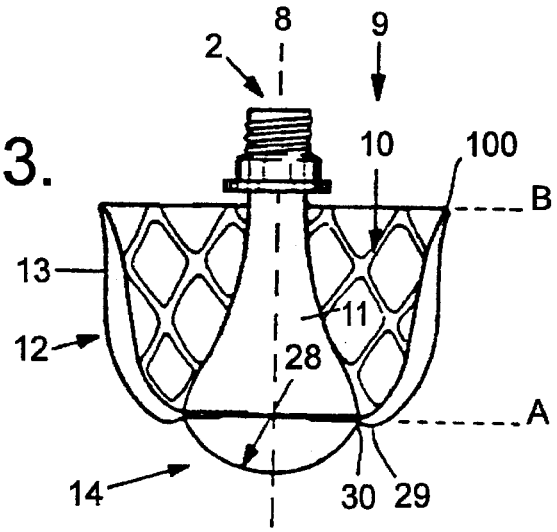
FIG. 3 is a schematic sectional view of the embodiment in FIG. 1 in a fully collapsed condition.

As will be seen with reference also to FIGS. 2 and 3, in response to a collapsing force directed longitudinally and relatively inwardly of container 1, in this example directed along longitudinal axis 8 in direction 9, container 1 progressively folds the folding portion 5 of the sidewall 4 such that as the size of the outwardly open recess 10 increases, the internal volume of container 1 will decrease.

As the folding action continues, so folding portion 5 will move relatively down the container 1 to position in receiving portion 12, which in this example is provided by girth portion 13 and base 14.

Turning now to consider the folding action in more detail, reference is once more made to FIG. 1. Folding portion 5 in this example includes an initiator portion 6 and control portion 7.

Initiator portion 6 in this example is formed to include alternate areas of strength and weakness, and is relatively more susceptible to collapsing in response to forces in direction 9 than the adjacent control portion 7 and neck portion 11. Thus, in response to a collapsing force in direction 9, a relatively controlled movement of initiator portion 6 will occur to initiate the folding action described earlier.

In this example of the invention, the alternate areas of strength and weakness in initiator portion 6 are provided by two adjacent, transversely arranged annular segments of the sidewall. The lines of weakness are defined at the interstices of the adjacent annular segments. Rather than any decrease in thickness of material by scouring or the like, the lines of weakness may be just changes in angle within the portion 6.

The control portion 7 in this example is provided with a plurality of substantially elongate polygonal panels 112 each having four sides to form a diamond shape. The panels 112 are each positioned so that they point along the longitudinal axis of the container and are positioned adjacent one another so as to provide the sidewall 4 with a substantially frustoconic shape.

The substantially frustoconic shape assists the folding portion 5 of sidewall 4 to position itself within receiving portion 12 as now explained. However, other shapes such as cylinders and polygons could be used for the folding portion 5 provided they utilise panel means such as 112. Such shapes would however affect the space into which the folding portion 5 was able to move in folding, and alter the ease with which the folding was formed. Referring particularly to FIGS. 2 and 3, apart from the lip 100 formed at the periphery of the recess 10 formed as the fold is created and rolled over and down the container, the diameter of the folded portions of folding portion 5 is less than the diameter of the portions remaining to be folded. Because of this, there is room for the folded portions to position in receiving portion 12 after folding.

Figure 20A:
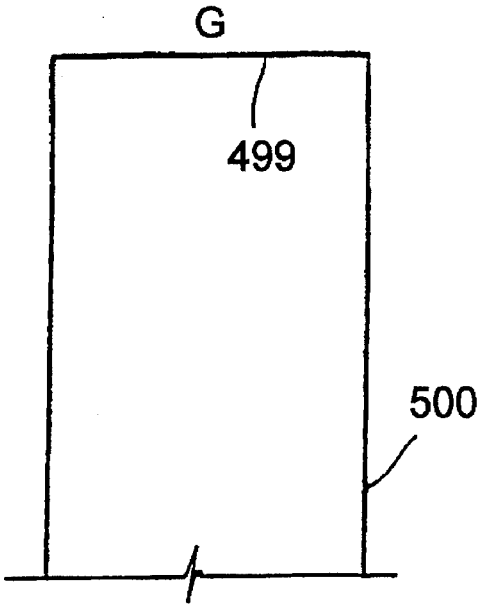
FIG.20a. (PRIOR ART)
FIGS. 20*a, b, c* illustrate very diagrammatically the effect of inverting or everting a cylindrical container.
Figure 20B:
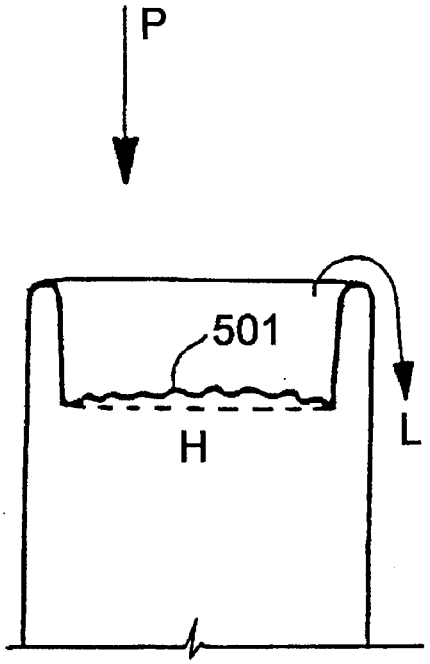
FIG.20b. (PRIOR ART)
Figure 20C:
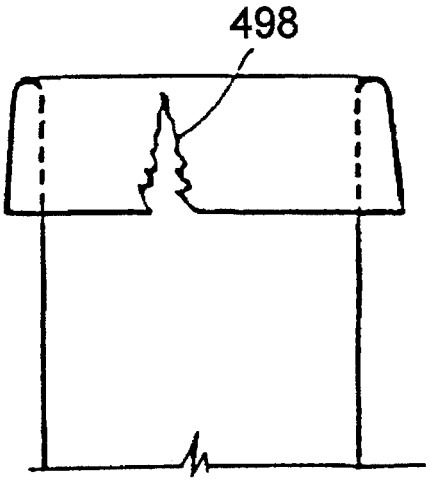
FIG.20c. (PRIOR ART)

Reference to FIG. 20 will further illustrate this point. If the sidewall 500 of a container is essentially cylindrical in shape as shown, rather than frustoconical, then attempting to fold the container in this way would result in the inverted ring formed from the top wall 499, having a diameter H (FIG. 20*b*), which would have to be less than its diameter G (FIG. 20*a*). This would result in axial stresses that would resist inversion. There would be no room within the cylinder into which the wall 500 could be folded, while retaining the original diameter G. There would be a corresponding transfer of force down the sidewall, in direction L, instead of into a fold and this would result in the cylinder wall 500 buckling, as shown at 501 in FIG. 20*b*, under a collapsing force in the direction P instead of inverting. The only way to make a cylinder behave in such a way, in fact, would be to hold it in an external frame or mould and invert it forcibly via a plunging device, which would thrust it into itself. The inverted segment would still buckle considerably due to its insistence on taking a reduced diameter (a circumference of given length must deform in order to reduce in diameter, at any point).

Alternatively, it must break or stretch as shown at 498 in order to increase in diameter, if everted for example (see FIG. 20*c*), but similarly an external device would have to be employed to influence such behaviour.

Therefore, in order to have a container that collapses only, with a force being directed longitudinally on it, and without employing the aid of an external device, the collapsing segment must, in the absence of the panels of the present invention, be frustoconical in shape, or the material must be somewhat elastic and capable of expansion or contraction—as it cannot retain the original dimensions in the new position.

Without such an initiator portion such as 6 in FIG. 1, even a frustoconical section could prove difficult to be collapsed by controlled inversion, particularly one of steep attitude and reasonable sidewall length. The sidewalls would not be able to withstand the forces of the top load and the container would simply deform and collapse completely at random. The force needed to start inversion at any point on the steep walls would be much greater than that required to deform and buckle the walls. Once part of the wall begins buckling the rest of the container continues this buckling pattern in response to further downward pressure.

Referring once again to FIGS. 1, 2 and 3, as may be appreciated, an operator applying a collapsing force in direction 9 will in practice direct the collapsing force only generally in the direction of arrow 9. There will be deviations in the direction of the force applied. The deviations in the collapsing force will, if not countered or otherwise diminished, result in irregular folding and rolling of the folding portion 5, particularly if collapsed too quickly. Irregular folding will in turn lead to a jamming and buckling of the sidewall 4 rather than the progressive folding action it is desired should occur in response to the collapsing forces.

The panels 112 of folding portion 5 are provided to enable folding of the container to occur in a predetermined and relatively regular manner.

The panels 112 of control portion 7 assist regular folding and reduce the tendency for the side wall to jam and buckle in response to collapsing forces. The way in which this occurs will be more readily understood by reference to FIGS. 4 and 5.

The panels 112 of the control portion 7 are shown shaped to be substantially arcuate, as viewed on end section. An indication of this arcuate shape can be seen with reference to FIG. 4 which is illustrative of a cross-section along the line X—X of FIG. 1. Providing the panels with an arcuate shape, such as that shown with reference to panel 112 in FIG. 4, enhances the control exerted by the panels 112 during folding. The term "arcuate" is used in the specification and claims to describe any profile of the container wall which projects away from the main circumferential plane of the container wall.

Figure 4:
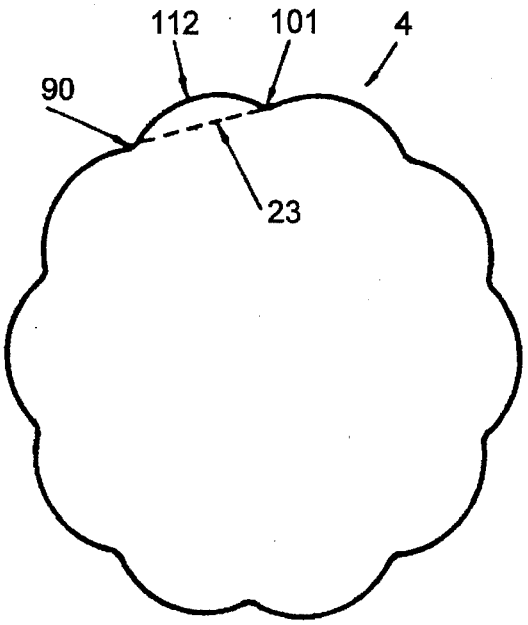
FIG. 4 is a schematic sectional view through line XX in FIG. 1.

In the orientation shown in FIG. 4, panel 112 has yet to be folded. The panel 112 is separated from adjacent panels by barrier means 90 and 101, provided in this example as relatively narrow non-arcuate portions of the sidewall 4, forming the frustoconical substrate network 111 of FIG. 1. The chord formed between the barrier means 90 and 101 is represented by dotted line 23.

As the container is collapsed and the sidewall 4 progressively folds inwards, so panel 112 will deform (by straightening) to lose its arcuate shape. As viewed in the drawings, the shape will be chordal. That is, substantially similar to the shape of chord 23.

Because the length of the arc of panel 112 (the arcuate length of panel 112) is greater than the length of the chord 23 (the chordal length 23), folding will cause a slight expansion in the periphery of the recess formed during the folding action. The chordal length between barrier means 90 and 101 at each side of panel 112 will increase to a maximum equal to the arcuate length of panel 112. Thereafter, as folding continues, a portion of the panel 112 having been folded will typically return to the substantially arcuate shape it adopted prior to straightening and folding.

Figure 5:
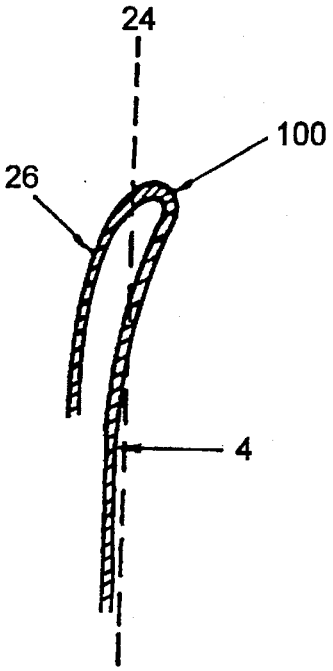
FIG. 5 is a detail of a fold in another exemplary embodiment of the invention.

The expansion of the periphery can be seen by reference to FIG. 5 which shows how the periphery of the recess being formed by sidewall 4 at its lip 100, bends out from its normal position substantially in line with the outside of the container, shown by line 24, as the fold 26 progresses down the sidewall.

Enabling the periphery to expand slightly allows a frustocone to invert with relative ease. Force is transferred radially to increase the periphery of the sidewall and is not transferred down the sidewall which could otherwise lead to buckling of the sidewall. This expansion of the periphery of the sidewall allows room for sections of the frustoconical sidewall to roll over into inversion and take their place inside the sidewall yet to folded. This accommodating feature of a frustoconical section with such panels 112 offers much less resistance to the waveform created by the periphery 100 of the recess 10 as it travels down the sidewall, as illustrated in FIG. 5.

Further, by dividing the sidewall 4 of the container into the adjacent panels 112 of this invention, the side wall 4 is divided into, and folds in portions of, predetermined chordal length. The periphery of the fold therefore forms into a polygonal shape, as defined by joining the chords formed during folding (see FIG. 4). The polygon formed will have a variable number of sides, depending on the number of panels employed and the amount of arc contained therein. Therefore, the periphery of the folding section (100 in FIG. 2) will not be circular as found in prior art proposals such as referred to above. This polygon formation helps direct the folded sections toward each other and to crimp together causing a latching effect to take place which is then further enhanced by the formation of the arcuate panels again once they have rolled over the chord and onto the other side. This latching effect prevents the folded portion from returning to the unfolded position, even under high internal pressure. The corners of the polygon formation are relatively close to the unfolded wall portion. In the case of the arcuate panels 112, the chordal length during folding will range between the length of the chord, as measured between the sides of the arc prior to folding, and the arcuate length of the panel 112, see FIG. 4.

By controlling the chordal length of the sidewall portions being folded, so the tendency for jamming and buckling to occur during folding is decreased. The panels 112 exert an evening effect on the fold 100 as it moves down the container, and this tends to correct any wrong deviation in the direction of collapse that is applied by an operator.

The diamond-shaped, arcuate panels 112 shown in this example of the invention assist and control the folding action of the control portion 7.

The barrier network 90, 101 that runs between the diamond-shaped arcs of the panels 112, forming the interconnecting substrate 111, provides the control portion 7 with the strength to resist any expansion when under biaxial pressure. When the container 4 is used for storage of aerated beverage and the like, simple elongate panels on the control portion, such as have been proposed for containers in the past, would allow the container walls to be flexible and therefore expand when under pressure from the contents. This would allow a headspace to build with resultant loss of carbonation.

The barrier network 90, 101 within the diamond panels 112 is tensed in both directions when the cap is placed on and internal pressure builds. The barrier network 90, 101 rests on a purely frustoconical base or substrate 111. It is mentioned that the shape, size and/or depth of this interconnecting network or substrate 111 between the panels can be varied as required to suit the desired characteristics of the resultant container. Such force attempts to cause movement in both directions on the diamond panels 112. Because the force in each direction is equal the diamond shape cannot alter. Because each panel 112 is a fixed size the control portion 7 cannot expand.

Once the cap is removed, however, there is no force in either direction. It is while the cap is off that an operator may, by choice, apply pressure in one direction, 9 in FIG. 1, (downwards to collapse the container). Because force is directed in one direction only, the diamond shape of the panels 112 can be forced to relax in the vertical and allow the arcuate panels 112 to begin influencing the periphery by donating otherwise redundant material. Thus peripheral expansion of the fold 100 is achieved and so is control of collapse in the manner already described.

The panels 112 also exert another major influence over the behaviour of the container 1 used as a collapsible container for liquids under pressure. The inverted section of the control portion is further prevented from being forced to revert to its original position. The folded over diamond arcs of the panels 112 re-expand once in the inverted position and tend to 'jam up' if force is applied to expand the container 4 from the collapsed state. This could be caused by a build-up of pressure within the contents if the container 4 was dropped, for example. The inverted section cannot fold back out, but tends to be held in place by the arcs that have been folded over. This enables the container to retain its integrity as a pressure vessel, even in a partially collapsed state.

In practice, polygons with a varying number of sides could be employed on the folding portion. They could be mixed shapes even though there would be no distinct advantage over the diamond network. However, polygons of increased or decreased number of sides could be employed with differing arrangements of arcing. Other geometric shapes could also be employed without departing from the scope of the invention.

The amount of arcing applied within the panels could also be varied according to the amount of control desired over the chord formation which affects ease of collapse. While arcing in the transverse or hoop direction is an essential requirement, arcing in the longitudinal direction may in most instances also be provided.

Figure 19A:
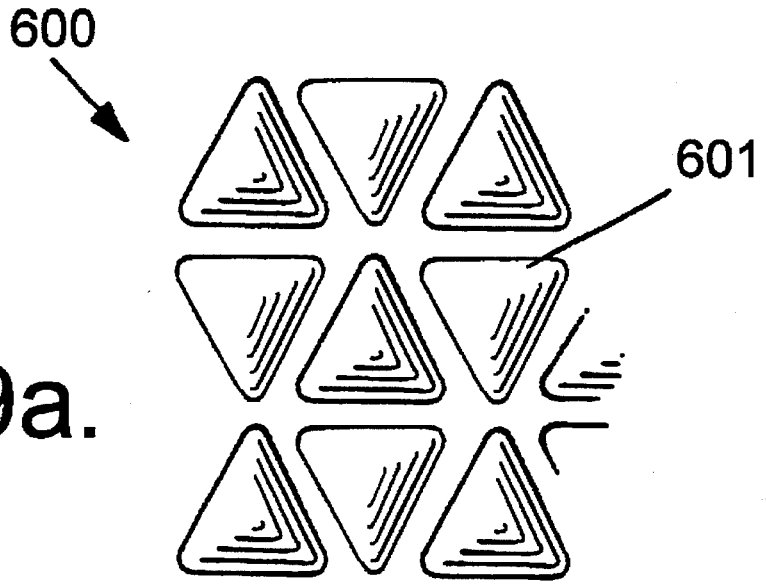
FIGS. 19*a* and 19*b* show possible alternative panel arrangements for further embodiments of the invention.
Figure 19B:
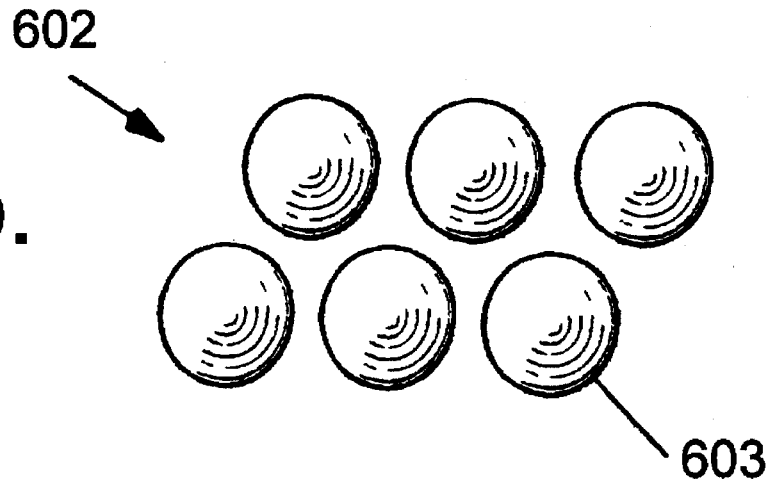

Thus referring to FIG. 19*a*, a folding section 600 of a container according to one possible embodiment is defined by a plurality of triangular panels 601, arced so that the panels peak at their centres. In FIG. 19*b* the folding section 602 of another embodiment has circular panels 603, again arced so as to peak at their centres.

Returning now to FIGS. 1, 2 and 3, it will be seen that base 14 is formed to provide a hollow 28. The hollow 28 is formed relative to those portions of neck 11 adjacent the folding portion 5 such that when container 1 is substantially fully collapsed and the fold 100 in the sidewall 4 is more or less at its greatest size, hollow 28 is substantially surrounded by neck portion 11.

Thus, as can be seen from FIG. 3, rim 29 of neck portion 11 in this example defines an area which on plan is at least equivalent to or preferably greater than the area defined by rim 30 of hollow 28. And, in the folded position shown, portions of rim 29 are circumferentially disposed relatively outwardly of rim 30 so as to assist the flow of fluid contained in the hollow 28 into the neck portion 11 and towards opening 2, during tipping rather than into the fold in sidewall 4.

Figure 6:
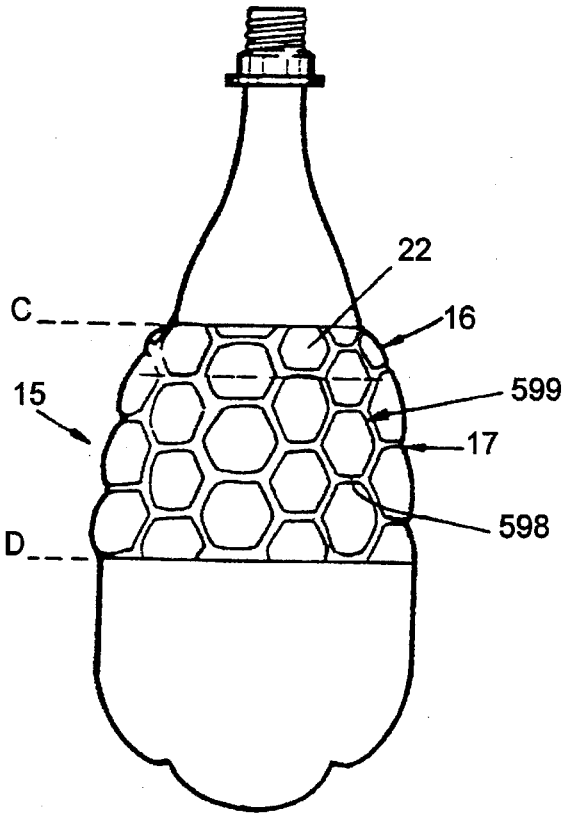
FIG. 6 is a schematic side view of a further exemplary embodiment of this invention.

Turning now to consider FIG. 6, an alternative arrangement for the folding portion can be seen. In FIG. 6, folding portion 15 includes initiator portion 16 and control portion 17. The control portion 17 in this example includes hexagonal panels 22.

The initiator portion 16 is also shown having hexagonal panels 22. The panels 22 that make up initiator portion 16 may if required be smaller and more numerous than the panels making up control portion 17 and may be offset relative to the positioning of the panels of the control portion 17.

For non-carbonated beverages and particularly for any hot-fill requirements, it may be desirable to employ a configuration that allows some contraction after filling. By altering the panel connecting barrier network configuration referred generally by 599, (111 in FIG. 1), it is possible to forego the ability of the control portion to contain pressure (which would not be needed for non-carbonated beverages in exchange for an ability to contract, for example).

An example of how this could be achieved would be by removing the transverse connecting portions 598 from the barrier network and allowing the arc from each hexagonal panel 22 to communicate in a longitudinal manner. Once again many variations could be employed without departing from the scope of the invention. All formations would fold in a polygonal shape as viewed from above.

This removal or alteration of the transverse or other connecting portions between panels 22 could be utilised in any of the other embodiments of the invention described herein.

As will be appreciated, in other embodiments of this invention other suitable arrangements for initiating and controlling folding may be provided on the folding portion. For instance, in at least one other embodiment of the invention, where panels are provided, single panels can extend through the control portion and initiator portion, substantially to traverse the whole of the folding portion of the container. An example of this type of embodiment is shown in FIG. 7.

Figure 7:
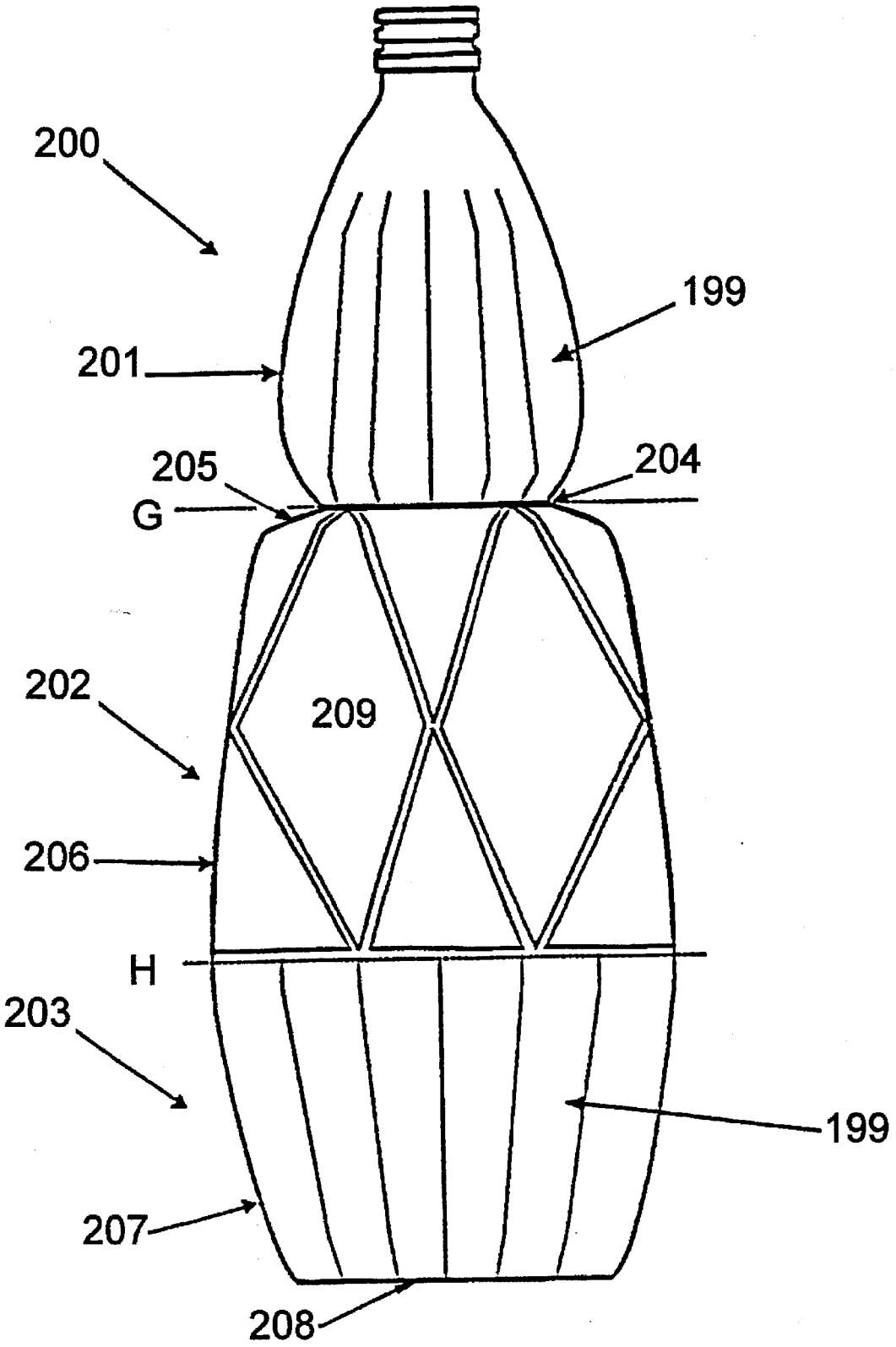
FIG. 7 is a schematic side view of still another exemplary embodiment of this invention.
Figure 8:
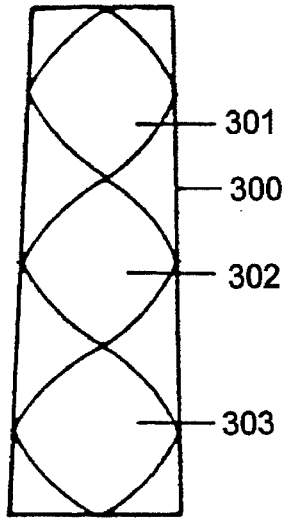
FIG. 8 is a schematic front view of a panel according to this invention.

Considering FIG. 7, container 200 can be seen including a neck portion 201, folding portion 202 defined between lines G and H and receiving portion 203.

The area immediately adjacent the intersection of neck 201 and folding portion 202 is provided with a recess 204 to assist handling of the container 200.

Folding portion 202 is provided with an initiator portion 205 and a control portion 206. Receiving portion 203 includes girth portion 207 and base 208.

As will be seen, the folding portion 202 is provided with a plurality of diamond shaped panels 209, which will be arcuate at least in the transverse direction, each panel being aligned with the longitudinal axis of the container 200 and positioned adjacent one another to provide the folding portion 202 with a substantially frustoconic shape.

In this example of the invention, panels 199 in the neck portion 201 and in the receiving portion 203 have a different function. These panels 199 do not assist folding but instead provide strength to the neck 201 and receiving portion 203 and assist those portions to resist buckling or otherwise deforming under axially directed folding forces. There is, relative to the arc provided to the panels 209, only a relatively slight arc in neck 201 and the receiving portion 203.

Further alternative forms of this invention may employ small arcuate panels around the recess 204. These panels may assist the recess to resist any plastic creep within the material when under very high pressure, as this area is normally not as strong as the rest of the container sidewalls due to the nature of biaxial orientation in manufacture. Other methods may also be employed to assist the strength of the recess 204 without departing from the scope of the invention, for example the addition of a strong, external retaining ring made of a suitable material being placed around the recess 204.

It is a still further object of this invention to provide an improved base section for a beverage container.

During bottle manufacture using biaxial orientation, the polymer molecular orientation is less at the top and bottom of the bottle so these areas need to be made thicker, but the common round design of the base minimises the material required (due to its better pressure containing capacity). With this rounded design the bottle cannot be stood upright, however, so a base 'cup' having a flat bottom is required. This may be injection moulded in PET or more usually high density polypropylene.

Much thought has been given, in the United States particularly, towards a base design which would obviate the need for a separate cup, and Continental Beverage Containers Inc have proposed a base having 4 or 5 extrusions which form feet on which the bottle can stand. This design, as mentioned previously, is usually referred to as a "petaloid" base and has drawbacks in that more material is required and the blow moulding machines need higher blow moulding and mould clamping pressures.

Another drawback is the many areas of differing material thickness distributed around the base. Very complex stress patterns are induced as a result of these varying thicknesses.

Another drawback is that the thick unstretched central area becomes a prime site for fracture under pressure and it is this area that is the most common site of bottom failure. This is because the intense pressure acts to "pull apart" and force outwards the surface presented.

Another drawback to this sort of base design is that the container cannot stand upright with stability on a grill-like surface, as is most common in refrigeration units. This has led to resistance from both the shop-keeper and the customer.

It is an object of these embodiments of the present invention to overcome some of these problems, or at least provide a suitable option.

So referring again to FIG. 7, exemplary base 208 is shaped to provide a hollow 211 substantially similar to that described earlier in relation to FIGS. 1, 2 and 3, to assist the collection and transmission of residual contents of the container to the opening 210. To assist the base 208 to withstand the internal pressures of typical aerated beverages, particularly where the container is formed in PET or the like, a relatively deep punt 211 is provided, the term 'punt' being that used to describe the hollow at the bottom of champagne bottles especially.

Exemplary base 208 provides an improvement over previous proposals by providing a fat, circular ring upon which the bottle rests, rather than feet (as is the case with a petaloid base). This full-contact ring allows greater stability when placed on incomplete surfaces such as the grills commonly found in refrigeration units.

Figure 9:
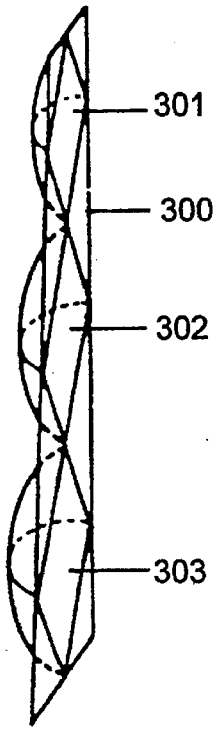
FIG. 9 is a schematic rearward perspective view of the panel in FIG. 8.
Figure 10:
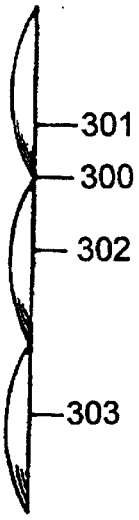
FIG. 10 is a schematic side view of the panel in FIGS. 8 and 9.
Figure 11:
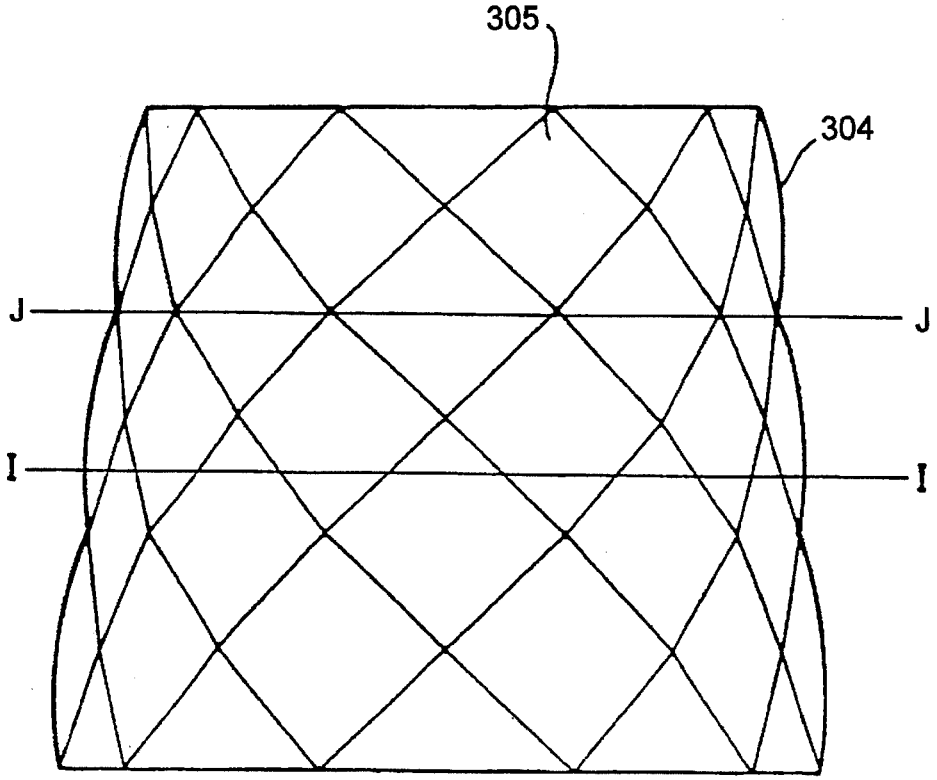
FIG. 11 is a schematic side view of an exemplary control portion of this invention.
Figure 12:
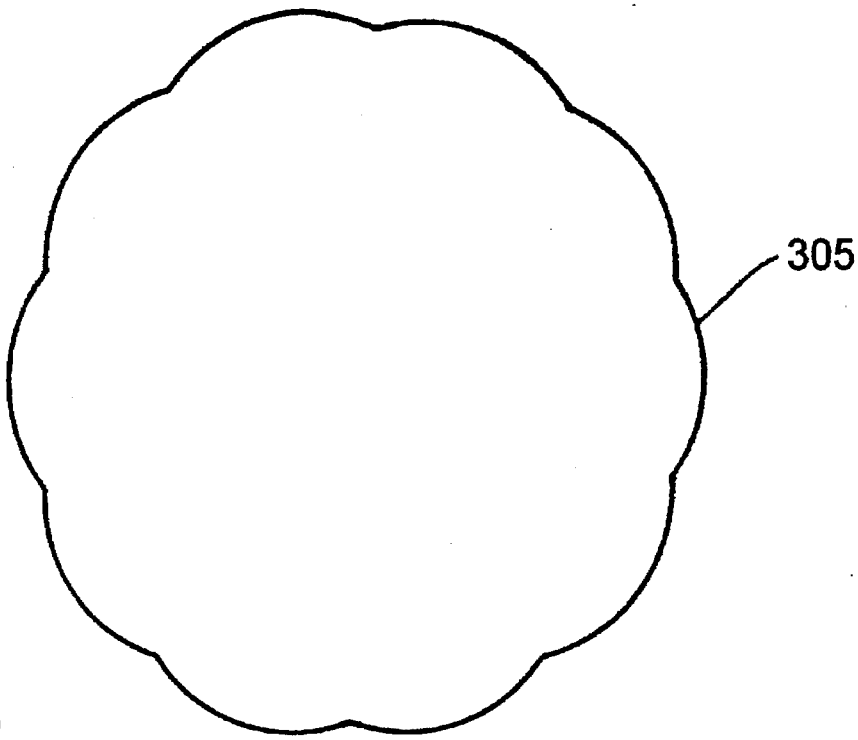
FIG. 12 is a cross-section through JJ in FIG. 11.
Figure 13:
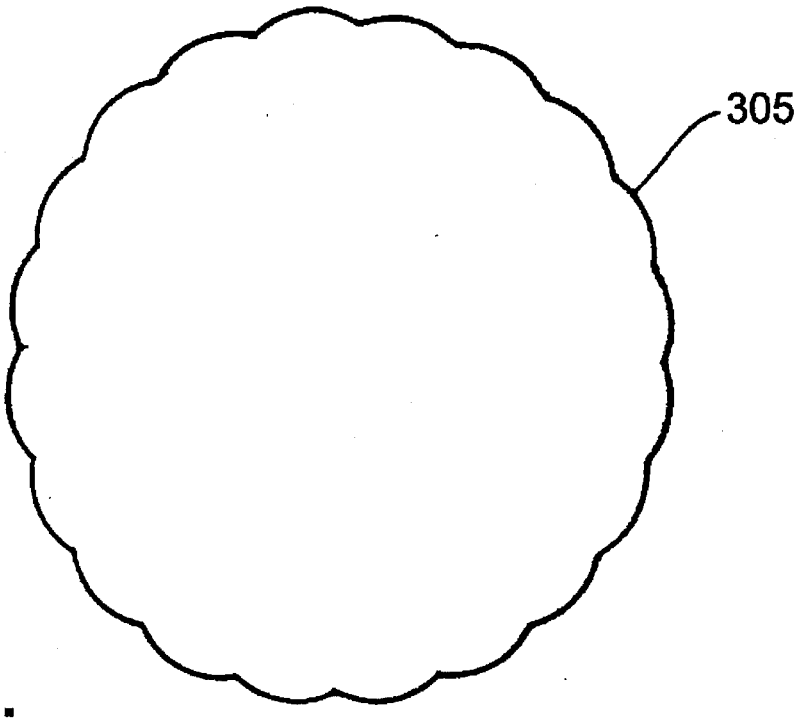
FIG. 13 is a cross-section through II in FIG. 11.

Referring to FIGS. 8 to 13 examples of the diamond shaped panels (209) such as of FIG. 7 are illustrated in greater detail. It is seen that the panels 301, 302, 303 can be provided so as to form a compositive panel 300 tapering towards one end. As the sectional and cross sectional views of FIGS. 9 and 10 illustrate the panels 301 to 303 are arcuate in beth transverse and longitudinal directions so as to control the folding as previously described. In FIGS. 11 to 13, the diamond panels 305 of the control portion 304 are shown to be arcuate and forming the frustoconical shape required for the folding action.

Figure 14:
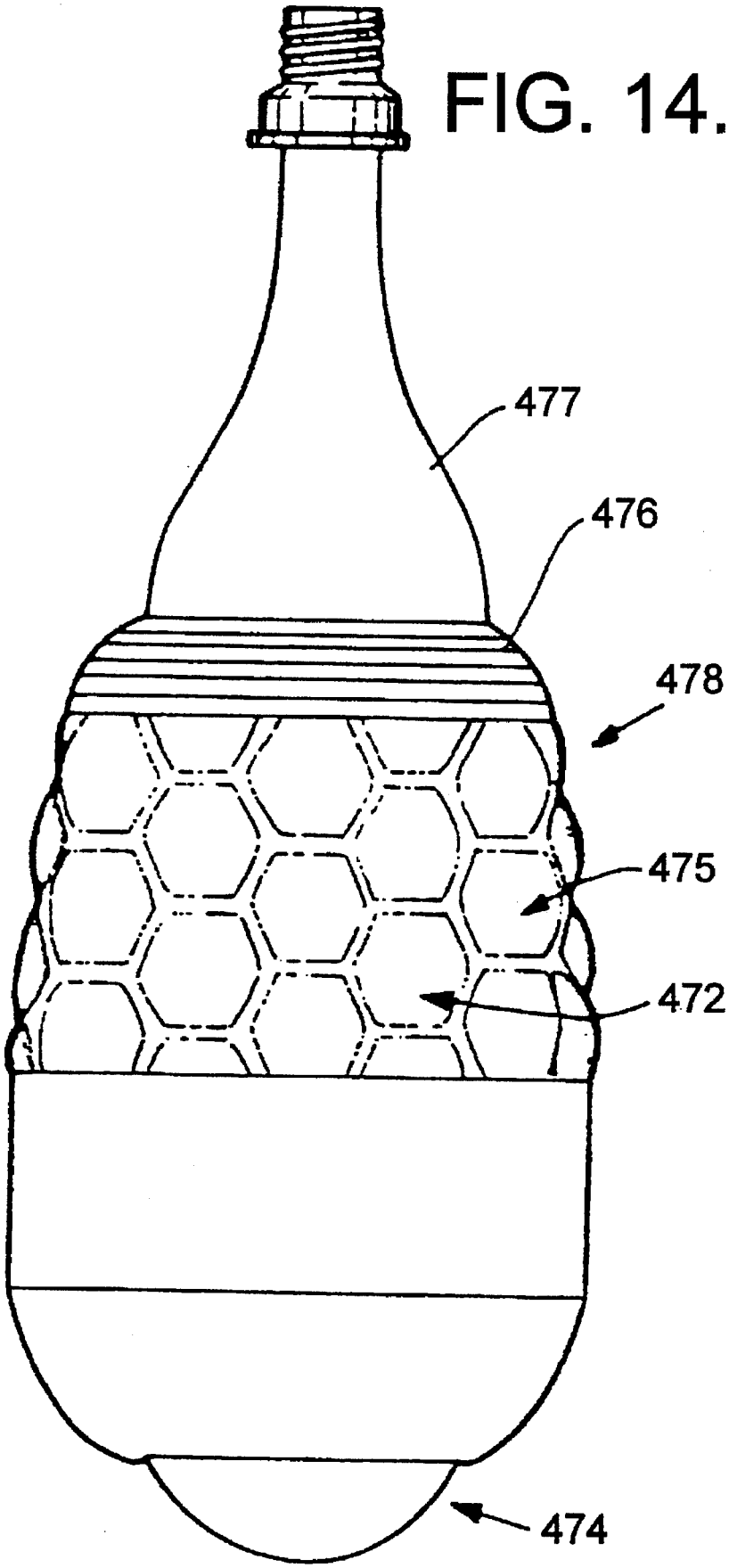
FIG. 14 is a schematic side view of a container according to another possible embodiment of the invention.

Referring now to FIG. 14, a further embodiment of the invention is illustrated and referred generally by arrow 478. This is shown with the diamond panels of the previous embodiments replaced with a plurality of hexagonal panels, 475, forming the folding portion 472. The initiator portion 476 is shown provided with a plurality of concentric lines of weakness, which may just be angular changes, leading up to the neck portion 477. The base 474 again provides an internal diameter commensurate with, or less than, that of the rim of the neck portion 477. The hexagons 475 are shown aligned in the direction of the longitudinal axis of the container 478. Each panel 475 will be arcuate at least in the transverse direction so as to permit collapsing axially as a result of a collapsing force, but to resist expansion circumferentially due to internal pressure.

Figure 15A:
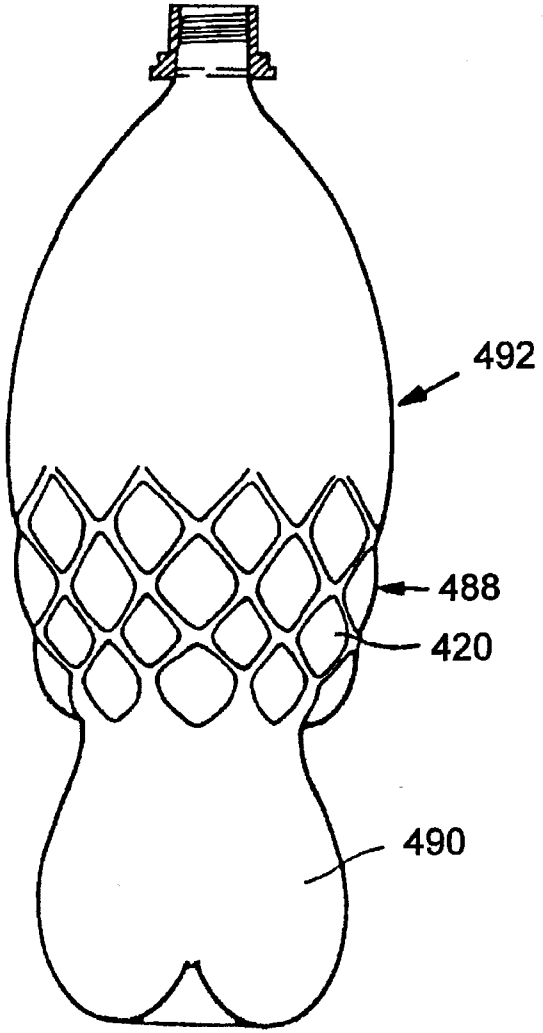
FIGS. 15*a, b, c* show a still further embodiment of the invention in its original, partially collapsed and fully collapsed positions.
Figure 15B:
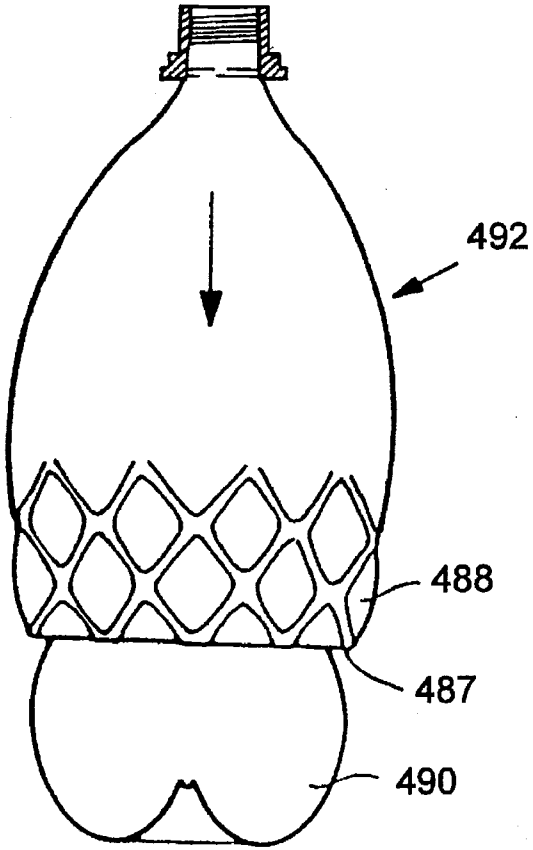
Figure 15C:
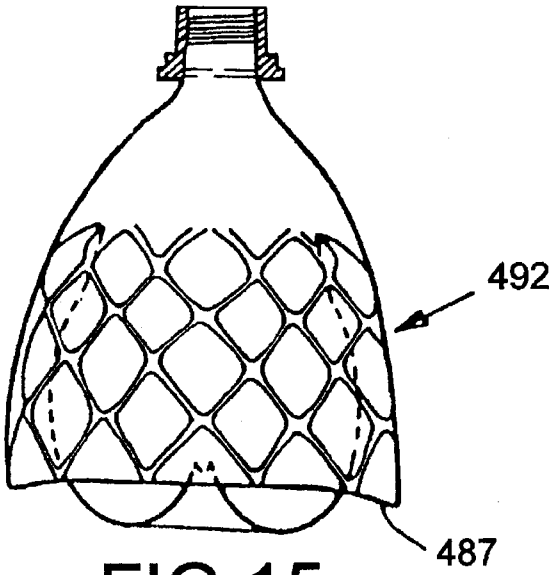

Referring now to FIGS. 15*a, b, c*, a further embodiment is referenced generally by arrow 492. It is seen to have a downwardly facing frustoconical folding portion 488 defined by a network of diamond shaped panels 420. This arrangement of the upward folding control section 488 allows for more complete emptying of the container as it is collapsed. No air at all can be trapped within the collapsing walls, as is common with 'upright' versions. This network of arcuate panels 420 resists the expansion forces and holds the folding portion 488 in place. The dimensions of these panels 420 can be different, of course. They could be wider on some containers than others, and even take differing sizes on a single container. When the cap is taken off, the network 488 is no longer under force from the beverage. Such force would normally attempt to cause movement in both the vertical and horizontal directions of each panel 420 of the network 488. Because the force in each direction is equal when the cap is on, the diamond-panelled network 488 cannot move. Once the cap is off, however, there is no force in either direction. It is while the cap is off that an operator may, by choice, apply pressure in one direction (downwards, as shown in FIG. 15(*b*), to collapse the container). Because force is directed in one direction only the diamond panels 420 of the network 488 can be forced to relax in the vertical and allow the arcuate panels 420 to begin influencing the periphery 487 by donating otherwise redundant material. Thus peripheral expansion of the fold 487 is achieved as it moves over the base 490 and so controls the container collapse in the manner already described.

Still other forms of the invention according to this and the other embodiments may employ more than one folding control section.

Figure 16:
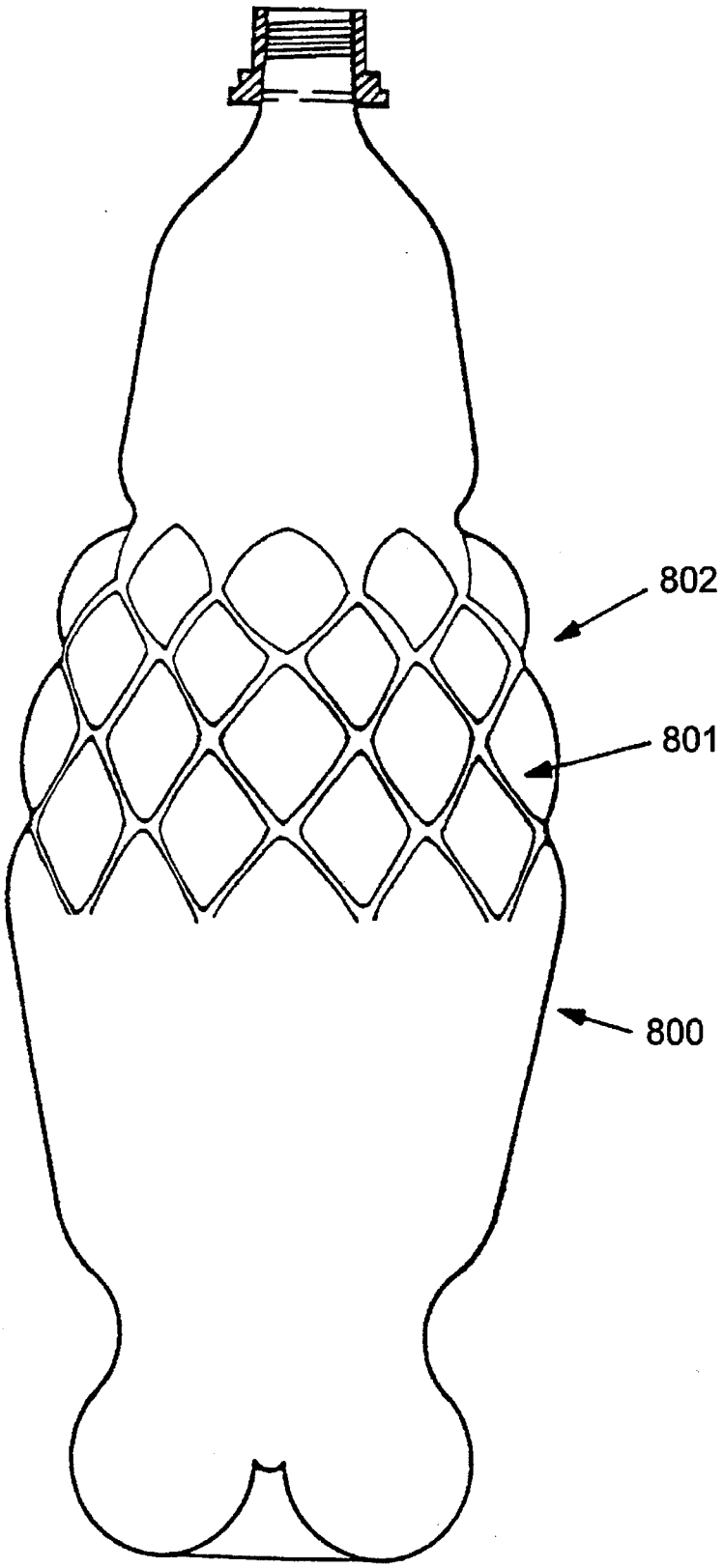
FIG. 16 shows very diagrammatically a still further embodiment of the invention.

Referring to FIG. 16, the container 800 of this embodiment has a folding portion 802 with diamond shaped arcuate panels 801 forming a frustoconical shape tapering upwardly rather than downwardly as in the previous FIGS. 15.

Figure 17:
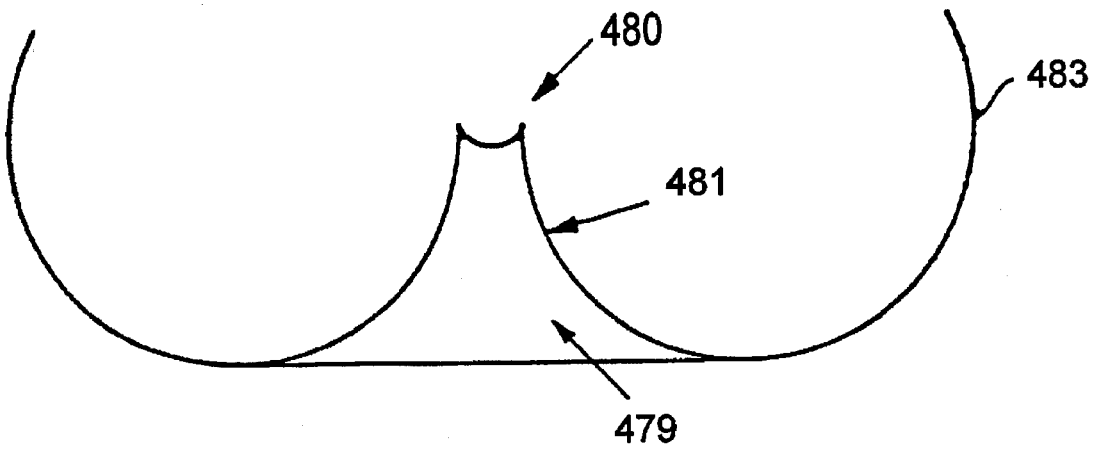
FIGS. 17 & 18 show very diagrammatically possible embodiments of a base for containers of the present invention.

Returning again to the formation of the base of the containers of the present invention, a further improvement is the more even distribution of material throughout the base. The inward presenting face, 480 of the base 483 in FIG. 17, is formed to be concave rotated around a central pillar 481 of relatively unstretched material about the punt 479. By placing the unstretched material in such a shape, it becomes self supporting under pressure and is therefore more protected from fracture. Not only is it self buttressing under pressure, but it becomes nearly impossible to force downwards 'out the bottom' of the container, as is a common failing of champagne-style punt bases made example thin material, that employ, for example, a convex dome presenting inwards.

In alternative forms of the invention the base may be provided with arcuate panels arrange to resist the folding forces mentioned above in relation to the example of the invention in FIG. 17. The addition of arcuate panels to this section increases the pressure carrying level. Just as arcuate panels can help material to fold in one direction, if they are reversed in direction the panels can inhibit any tendency to fold. By employing them near the central column 481 in FIG. 17, any affinity the base has to be forced downwards and fold out under the pressure is reduced significantly.

Figure 18:
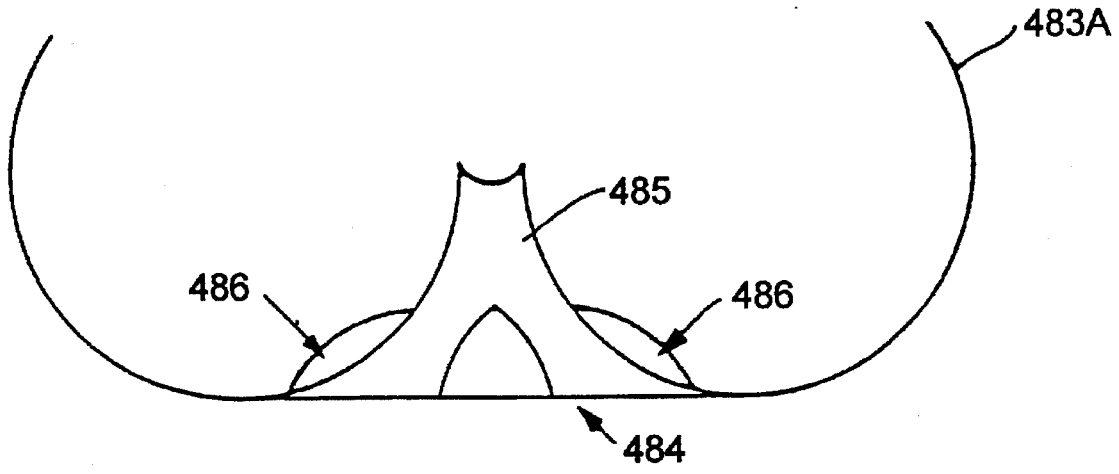

FIG. 18 shows a further exemplary base 483A, employing such arcuate panels 486 about the hollow column 485 of the punt 484 to increase pressure thresholds. Further panel arrangements may be employed without departing from the scope of this invention.

Still further alternative forms of this invention may use an eversion folding movement, instead of an inversion folding process. A container according to this invention could have a folding portion with an everting initiator portion and an everting control portion. The arcuate diamond or other shaped panels in such embodiments would face inwards, not outwards.

It is seen that the present invention in its various embodiments provides a container which has different portions capable of accommodating different loadings and where the collapsing is achieved through a middle portion folding and not by an end being pushed inwardly.

Thus, it will be appreciated that by this invention there is provided an improved container wherein control of progressive folding of the sidewall of the container so as to collapse it, is assisted, and in preferred embodiments the base is also designed to carry higher pressures and afford the container increased stability.

Where in the foregoing description reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope or spirit of the invention as defined in the appended claims.

I claim:

1. A semi-rigid container having a longitudinal axis extending from a neck portion to a base portion and a transverse axis perpendicular to said longitudinal axis, said container comprising a side wall connecting the neck portion to the base portion, the side wall of said container including a semi-rigid folding portion having a plurality of panel means for providing rigidity against a collapsing force in the direction of said longitudinal axis and tending to move said neck portion towards said base portion, said panel means being flexible against a force in the direction of said transverse axis, whereby the outside surface of said folding portion folds relative to a remaining portion of said container by progressively inverting and thereby reducing the internal volume of said container, and wherein said folding portion includes an initiator portion for defining where folding will commence, the initiator portion of the folding portion of the side wall including a zone angled to be substantially more perpendicular relative to the longitudinal axis of the container than any other zone in the folding portion.

2. A semi-rigid container as claimed in claim 1 wherein said folding portion is of a substantially frustoconical shape, the central axis of said frustoconical shape coinciding with the longitudinal axis of the container.

3. A semi-rigid container as claimed in claim 2 wherein said frustoconical shape tapers inwardly towards the neck portion of said container so that under said collapsing force said neck portion moves inwardly of said folding portion and the base portion of said container.

4. A semi-rigid container as claimed in claim 2 wherein said frustoconical shape tapers inwardly towards the base portion of said container so that under said collapsing force said base portion moves inwardly of said folding portion and the neck portion of said container.

5. A semi-rigid container as claimed in claim 1 wherein each said panel means has a substantially polygonal shape.

6. A semi-rigid container, having a longitudinal axis extending from a neck portion to a base portion and a transverse axis perpendicular to said longitudinal axis, a side wall connecting the neck portion to the base portion, the side wall of said container including a semi-rigid folding portion having a plurality of panel means each having a profile which projects away from the main circumferential plane of the side wall to provide rigidity against a collapsing force in the direction of said longitudinal axis and tending to move said neck portion towards said base portion, said panel means being flexible, against a force in the direction of said transverse axis, said panel means being so disposed in the side wall adjacent one another that said folding portion under said collapsing force can fold relative to a remaining portion of said container by progressively inverting into a collapsed state where the base and neck portions are positioned closer together in reducing the internal volume of said container, the panel means acting together to resist expansion of said folding portion from the collapsed state and wherein the folding portion includes an initiator portion for defining where folding will commence, the initiator portion of the folding portion of the side wall including a zone angled to be substantially more perpendicular relative to the longitudinal axis of the container than any other zone in the folding portion.

7. A semi-rigid container as claimed in claim 6 wherein the profile of each said panel means is arcuate as it projects away parallel with the transverse axis of the container.

8. A semi-rigid container as claimed in claim 7 wherein the profile of each said panel means if arcuate also as it projects away parallel with the longitudinal axis of the container.

9. A semi-rigid container as claimed in claim 8 wherein said panel means are provided in said initiator portion.

10. A semi-rigid container formed from a semi-rigid material having a longitudinal axis extending from a neck portion to a base portion, a side wall connecting the neck portion to the base portion, the side wall of said container including a semi-rigid folding portion having a plurality of panels for providing rigidity against a collapsing force in the direction of said longitudinal axis and tending to move said neck portion towards said base portion, a transverse axis of said container being perpendicular to said longitudinal axis and said panels being flexible against a force in the direction of said transverse axis, each of said panels having an arcuate profile parallel with said transverse axis to provide said rigidity against said collapsing force but to allow the outside surface of said folding portion to fold relative to a remaining portion of said container by progressively inverting into a collapsed state and thereby reducing the internal volume of said container, said folding portion including an initiator portion defining where folding of said container will commence in response to said collapsing force, the initiator portion being inclined relative to said longitudinal axis of the container at an angle greater than the angle at which the remainder of the folding portion is inclined to the longitudinal axis of the container, said panels as they are folded over as the folding portion folds acting to resist the re-expansion of the folding portion.

* * * * *